US005122714A

United States Patent [19]

Chermin et al.

[11] Patent Number: 5,122,714

[45] Date of Patent: Jun. 16, 1992

[54] SWITCHING DEVICE AND HIGH-PRESSURE DISCHARGE LAMP

[75] Inventors: Hubertus M. J. Chermin; Egbert Van Zanten, both of Eindhoven, Netherlands

[73] Assignee: U.S. Philips Corporation, New York, N.Y.

[21] Appl. No.: 504,199

[22] Filed: Apr. 3, 1990

[30] Foreign Application Priority Data

Apr. 4, 1989 [NL] Netherlands ..... 8900822

[51] Int. Cl.[5] ..... H05B 37/00

[52] U.S. Cl. ..... 315/289; 315/290; 315/70; 315/57

[58] Field of Search ..... 315/289, 290, 45, 209 CD, 315/70, 58, 57, 276; 361/275; 336/69, 178, 220, 232

[56] References Cited

U.S. PATENT DOCUMENTS

| | | | |
|---|---|---|---|
| 3,691,435 | 9/1972 | Winn | 361/275 |
| 4,103,209 | 7/1978 | Elms | 315/243 |
| 4,134,042 | 1/1979 | Veeckens | 315/59 |
| 4,223,247 | 9/1980 | Jacobs | 315/70 |
| 4,353,012 | 10/1982 | Fallier | 315/289 |
| 4,403,173 | 9/1983 | Mayer | 315/289 |
| 4,461,982 | 7/1984 | Fähnrich | 315/289 |
| 4,629,945 | 12/1986 | Fallier | 315/289 |
| 4,724,362 | 2/1988 | Lester | 315/289 |
| 4,818,917 | 4/1989 | Vest | 315/33 |

OTHER PUBLICATIONS

Neues aus der Technik Feb. 15, 1988 p. 1.

*Primary Examiner*—Eugene R. LaRoche
*Assistant Examiner*—A. Zarabian

[57] ABSTRACT

A transformer (10) which forms part of a lamp ignition switching device has at least its primary winding (12) composed of a foil. Moreover, the transformer has an air core. In this way a satisfactory coupling, which is also maintained at high temperatures, is obtained between the primary (12) and the secondary (11) winding. This switching device is very suitable to be built in a lamp and to ignite the lamp at a high temperature.

6 Claims, 1 Drawing Sheet

SWITCHING DEVICE AND HIGH-PRESSURE DISCHARGE LAMP

The invention relates to a switching device suitable for igniting at least a high-pressure discharge lamp, which switching device comprises a transformer having a primary winding and a secondary winding. The invention also relates to a high-pressure discharge lamp provided with such a switching device.

A switching device as described in the opening paragraph is known from "Neues aus der Technik", Feb. 15, 1988, page 1. Such a switching device has good properties for igniting different types of lamps. The device operates as follows: a voltage pulse is generated in a secondary winding of the transformer. This voltage pulse is capable of initiating the gas discharge process in the discharge tube of the lamp. If the lamp is ignited, the gas discharge process is maintained by a separate supply voltage.

Such a switching device may be built in the lamp. The lamp thus constructed may be operated without a separate starter being required, which provides more possibilities of using this lamp.

The value of the voltage pulse which is generated by the switching device is dependent on the coupling between the primary and the secondary winding of the transformer. Generally, a satisfactory coupling is realised by providing the transformer with a core of a magnetizable material. A drawback of such a transformer is that the coupling between primary and secondary winding is considerably reduced at a high temperature. This drawback notably presents itself if the transformer is placed close to the lamp or if it is present within the lamp. In such cases a high-voltage pulse cannot be generated immediately after extinction of the lamp when the lamp and the transformer are still hot. For this reason the known switching device is, inter alia, unsuitable for the so-called hot reignition of a high-pressure discharge lamp.

One of the objects of the invention is to realise the satisfactory ignition properties of the switching device also at high temperatures.

According to the invention a switching device of the type described in the opening paragraph is therefore characterized in that a primary winding of the transformer is composed of a foil and in that the transformer has an air core.

A satisfactory coupling has been established, also at high temperatures of the transformer, between the primary and the secondary winding of a transformer according to the invention. As a result it appears to be possible to form the transformer with an air core. It has the advantages of an economy in material and a simpler construction of the transformer.

If a secondary winding of the transformer is incorporated in a connection conveying a lamp current, at least a portion of the lamp current will flow through the secondary winding of the transformer, when the lamp is ignited. The resistance of the secondary winding can be given a relatively low value, also at small dimensions of the transformer, by composing the secondary winding of the transformer also of a foil. This is advantageous because it will lead to a small power dissipation in the secondary winding, both during ignition of the lamp and during stationary lamp operation.

In a preferred embodiment of a switching device according to the invention which, in addition to the transformer comprises at least a further circuit element, the further circuit element is at least partly surrounded by the transformer. Such an embodiment advantageously utilizes the fact that the transformer has an air core and that it accommodates the further circuit element. A compact design of the switching device can thus be realised.

The invention also relates to a high-pressure discharge lamp suitable to be ignited by means of a switching device as described hereinbefore and having a lamp cap and an outer envelope, which lamp is characterised in that the switching device is built in the lamp between the outer envelope and the lamp cap.

The satisfactory coupling between primary and secondary winding of the transformer at high temperatures renders the switching device very suitable to be built in a lamp between the outer envelope and the lamp cap. In a lamp thus formed the advantages of incorporating the switching device in the lamp are combined with satisfactory ignition properties of the lamp, even at high temperatures.

In a preferred embodiment of such a lamp the transformer of the built-in switching device forms part of a connection element between the lamp cap and the outer envelope and thus not only fulfils an electrical function but also a constructive function in the lamp.

The secondary winding of the transformer of the switching device may be incorporated in a connection conveying the lamp current. It is also possible for the secondary winding to be electrically connected to an ignition electrode of the lamp.

An embodiment of the invention will now be described in greater detail by way of example with reference to the accompanying drawing in which.

BRIEF DESCRIPTION OF DRAWINGS

In FIG. 1 of the drawing the reference numeral 1 denotes a lamp having connection terminals A and B. A power supply source has terminals C and D. Terminal B is connected to terminal D and terminal C is connected to terminal A via a ballast 2. The lamp comprises a switching device according to the invention, constituted by circuit elements 10, 14, 15 and 16. The switching device is constructed as follows. A secondary winding 11 of a transformer 10 is arranged in series with a discharge vessel 13 of the lamp between the terminals A and B. The secondary winding and the discharge tube are shunted by a capacitor 14, possibly with a resistor 16. The capacitor is shunted by a primary winding 12 of the transformer 10 and a glow discharge starter 15.

In FIG. 2 transformer 10 surrounds one end of an outer envelope 9 on one side and is connected to a lamp cap 17 on the other side. A space bounded by the outer envelope, the transformer and the lamp cap accommodates capacitor 14, glow discharge starter 15 and resistor 16.

Figure 1:
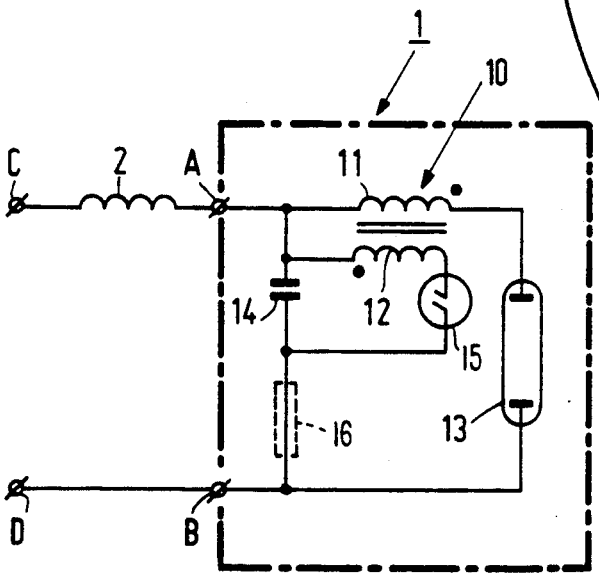
FIG. 1 shows diagrammatically alamp comprising a switching device according to the invention and FIG. 2 shows an embodiment of a lamp provided with a switching device of FIG. 1.
Figure 2:
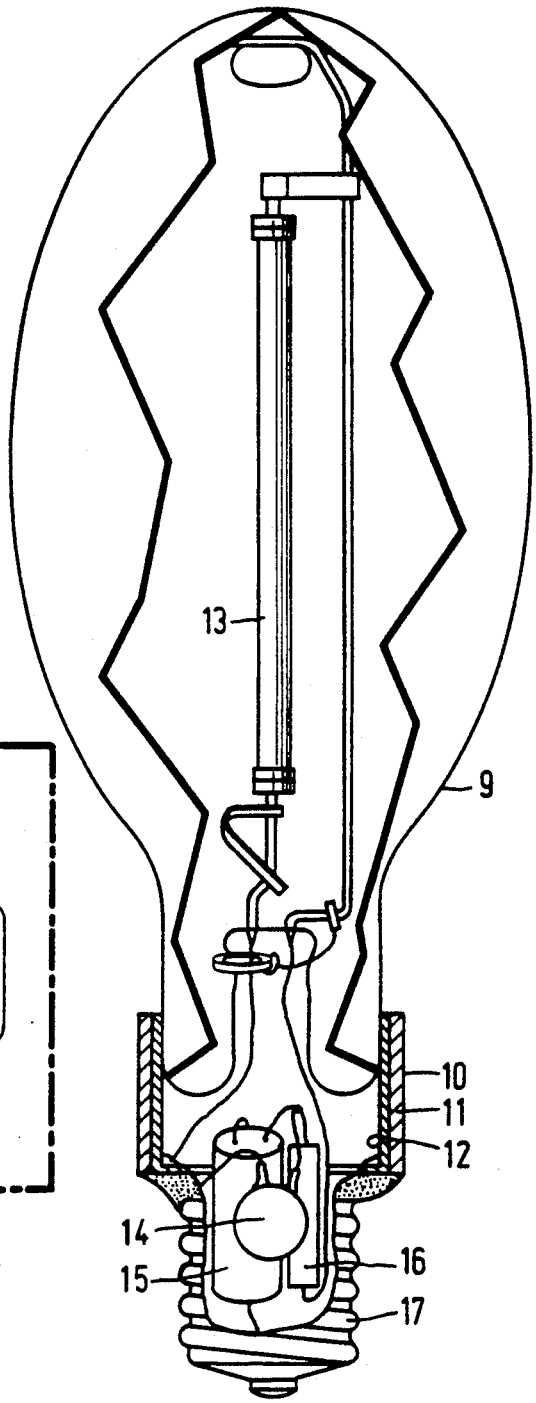

In a concrete embodiment a high-pressure sodium lamp (power 110 W) was used. The transformer was constructed as follows: an aluminium foil whose thickness was 16 microns and whose width was 18 mm was wound with an insulation foil around a cylindrical tube of a non-conducting synthetic material having a cross-section of 30 mm and a length of 24 mm. Successive turns of the aluminium foil were mutually insulated by means of the insulation foil. The primary and the secondary winding were both made of aluminium foil and insulation foil and the number of turns was 10 and 100, respectively. Both at room temperature and in a hot state voltage pulses of approximately 8 kV were obtained on the secondary winding by means of this transformer, which pulses appeared to be sufficient to ignite the lamp both in a cold and in a hot state.

We claim:

1. A combination including a high pressure discharge lamp having a body and a switching device suitable for igniting said high pressure discharge lamp, said switching device comprising a transformer having a primary winding and a secondary winding, wherein the primary winding of the transformer is composed of a foil and wherein the transformer has an air core, said body of said high pressure discharge lamp having a lamp cap and an outer envelope, said switching device being incorporated in the body of said lamp between the outer envelope and the lamp cap.

2. A combination in accordance with claim 1, wherein said secondary winding is composed of a foil.

3. A combination in accordance with claim 1, wherein said switching device comprises a circuit element which is at least partly surrounded by said transformer.

4. A combination in accordance with claim 1, wherein said transformer forms part of a connection element between said lamp cap and said outer envelope.

5. A combination in accordance with claim 2, wherein said transformer forms part of a connection element between said lamp cap and said outer envelope.

6. A combination in accordance with claim 3, wherein said transformer forms part of a connection element between said lamp cap and said outer envelope.

* * * * *